United States Patent [19]

Leipelt et al.

[11] Patent Number: 4,993,517

[45] Date of Patent: Feb. 19, 1991

[54] OIL-FILL OPENING FOR INTRODUCING LUBRICATING OIL INTO AN INTERNAL COMBUSTION ENGINE

[75] Inventors: Rudolf Leipelt, Marbach; Karl-Heinz Messner, Benningen, both of Fed. Rep. of Germany

[73] Assignee: Filterwerk Mann & Hummel GmbH, Ludwigsburg, Fed. Rep. of Germany

[21] Appl. No.: 516,747

[22] Filed: Apr. 30, 1990

[30] Foreign Application Priority Data

May 5, 1989 [DE] Fed. Rep. of Germany ..... 3914759

[51] Int. Cl.[5] ..... F16N 21/00

[52] U.S. Cl. ..... 184/105.1; 123/41.86; 123/572; 137/171; 220/253; 220/255

[58] Field of Search ..... 184/1.5, 105.1, 88.1, 184/92, 94, 6.23; 220/293, 469, 253, 255; 55/462, 465; 141/59; 137/171, 172; 123/572, 41.86

[56] References Cited

U.S. PATENT DOCUMENTS

| | | | |
|---|---|---|---|
| 1,761,944 | 6/1930 | Taylor | 123/41.86 |
| 1,822,201 | 9/1931 | Cochrane | 123/41.86 |
| 3,774,722 | 11/1973 | Elder | 184/105 |
| 4,169,432 | 10/1979 | White | 123/41.86 |
| 4,401,093 | 8/1983 | Gates, Jr. et al. | 123/573 |
| 4,579,092 | 4/1986 | Kandler | 123/41.86 |

FOREIGN PATENT DOCUMENTS 3046232 7/1982 Fed. Rep. of Germany .

*Primary Examiner*—Ira S. Lazarus
*Assistant Examiner*—Alan B. Cariaso
*Attorney, Agent, or Firm*—Foley & Lardner, Schwartz, Jeffery, Schwaab, Mack, Blumenthal & Evans

[57] ABSTRACT

A oil-fill opening 12 for introducing lubricating oil into an internal combustion engine provided with a cap 15 which has a bayonet lock. On the outside of the wall of the oil-fill opening there is an oil separator 22 through which the blow-by gases from the crankcase are conveyed to the intake manifold and/or to the clean-air side of the air filter. Oil collected in the oil separator 22 is returned through a return port 23, 24 between the oil separator 22 and the oil-fill opening 12. To prevent oil from getting into the oil separator when oil is poured into the oil-fill opening 12 and backing up therein so that under certain circumstances it reaches the clean-air side of the air filter, a shutter 25 in the form of a rotary slide valve, which covers the return port 23, 24 between the oil separator 22 and the oil-fill opening 12 when the cap 15 is removed, is provided within the oil-fill opening. The turning of the cap 15 when the cap is opened causes the slide valve to positively cover the return port, and when the cap 15 is closed, the return port 23, 24 is again uncovered.

8 Claims, 2 Drawing Sheets

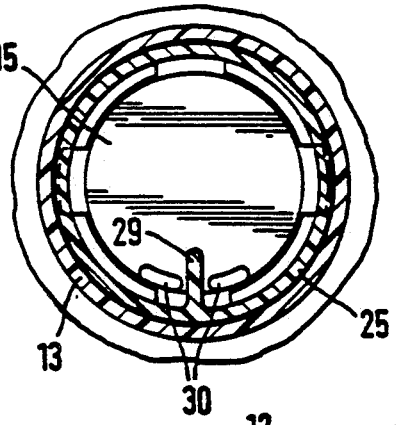
FIG.1a
FIG.1
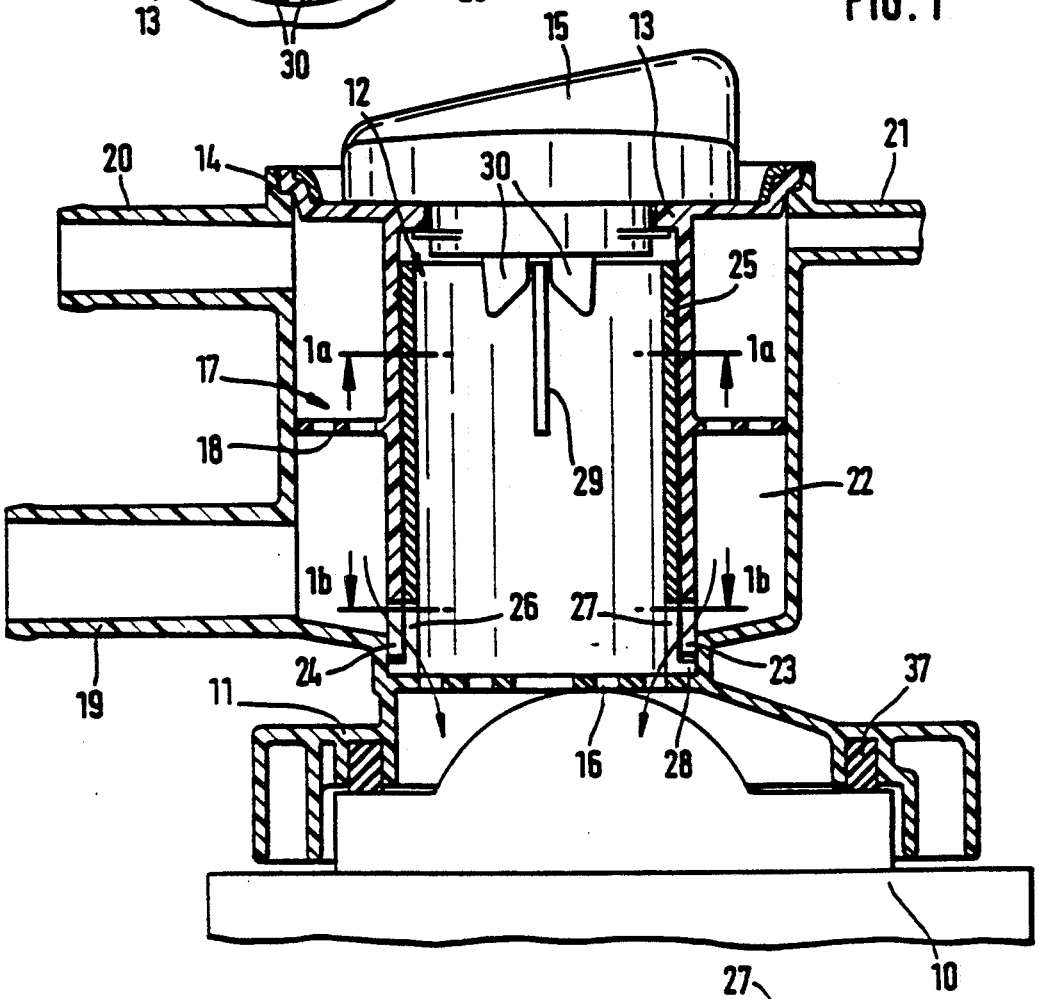
FIG.1b
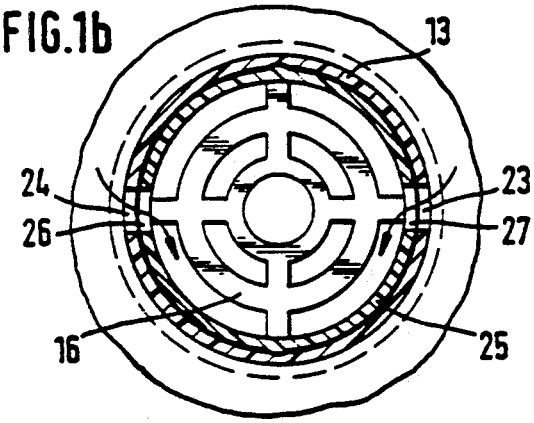
FIG.1c
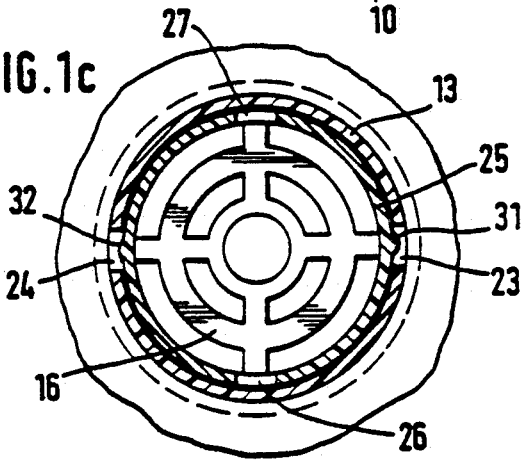

OIL-FILL OPENING FOR INTRODUCING LUBRICATING OIL INTO AN INTERNAL COMBUSTION ENGINE

BACKGROUND OF THE INVENTION

This invention relates to a oil-fill opening for introducing lubricating oil into a crankcase of an internal combustion engine comprising an oil-fill opening for introducing lubricating oil into a crankcase of an internal combustion engine, comprising a tubular oil-fill opening; a cap for opening and closing the oil-fill opening; an oil separator adjacent the oil-fill opening through which blow-by gases from the engine crankcase are conducted to the engine intake manifold or to the clean-air side of the engine air filter, and a return port communicating between the oil separator and the oil-fill opening for returning lubricating oil collected in the oil separator.

Such oil-fill openings are advantageously disposed on the valve chamber cover of the engine and generally comprise an oil-fill neck which is closed by a cap with a bayonet lock.

It is furthermore known to feed the blow-by gases which form in the crankcase through an oil separator to the engine intake manifold or to the clean-air side of the engine air filter. The oil collected in the oil separator is to be returned to the oil circuit. It has therefore proven desirable to dispose the oil separator, which separates the oil contained in the blow-by gas, directly adjacent the oil-fill opening and to create a connection between the oil separator and the oil-fill opening so that the separated oil can flow back into the valve chamber. It has been found, however, that when oil is poured into the oil-fill opening, especially when very large amounts of oil are poured in within a short period of time, there is a danger that this oil will get into the oil separator and, under certain circumstances, it may enter the line connecting the oil separator to the intake manifold. This results in the air filter cartridge being ruined by the inflowing oil.

SUMMARY OF THE INVENTION

It is the object of the present invention to provide an oil-fill opening which substantially prevents oil introduced therethrough into an engine from flowing into an adjacent oil separator for blow-by gases from the crankcase and possibly ruining the air filter cartridge of the engine.

This and other objects are achieved in accordance with the present invention by providing an oil-fill opening for introducing lubricating oil into a crankcase of an internal combustion engine, comprising a tubular member defining an oil-fill opening; a cap with retaining means for opening and closing the oil-fill opening; an oil separator arranged adjacent the oil-fill opening through which blow-by gases from the crankcase of the engine are conducted to an engine intake manifold or to the clean-air side of an engine air filter; at least one return port communicating between the oil separator and the oil-fill opening for returning lubricating oil collected in the oil separator; a shutter comprising a rotary slide valve within the oil-fill opening for opening and closing the return port; and means for connecting the shutter to the cap such that when the oil-fill opening is closed by the cap, the shutter is actuated to open the return port, and when the oil-fill opening is opened by means of the cap, the shutter is actuated to close the return port.

One important advantage of the invention is that, when oil is poured into the oil-fill opening, no additional measures, such as for example the closing of a valve, are necessary to prevent oil from entering the oil separator. Instead, the return line from the oil separator to the oil-fill opening is automatically effectively sealed off whenever the oil-fill opening is opened so that the possibility of error is prevented. The oil return port is opened in the same manner without the need for additional manipulations, so that it is assured in every case that, when the oil-fill opening is closed, oil which collects in the oil separator will be able to flow unhindered into the valve chamber.

It is furthermore advantageous that the shutter comprises a rotary slide valve which only takes up a little space, so that the introduction of oil into the engine crankcase through the oil-fill opening will not be hindered by the shutter.

According to a further development of the invention, the oil separator is disposed annularly surrounding the oil-fill opening, and several oil return ports are provided. The shutter is then preferably configured as a thin-wall tube lying against the inside wall of the oil-fill opening. This tube is provided with openings which uncover the oil return ports. Such a tube can easily be inserted when the oil-fill opening is assembled. The shutter is held in its installed position by a flange on its bottom margin.

According to an additional advantageous embodiment of the invention, the actuating coupling between the cap and the shutter comprises an interlocking, releasable connection which is formed by a lug-like projection on the shutter which is straddled by a driving fork on the cap. It is, of course, possible to provide other kinds of actuating connections. It would also be possible to provide a pin which engages in a hole. In such embodiments the important thing is that turning movements of the cap are transferred to the shutter.

According to a further development, to prevent unintentional turning the shutter is provided with detents which engage recesses in the positions in which the oil separator is closed or open. These detents can be disposed, for example, in the plane of the oil return openings and can engage in the return openings in the closed position.

It has furthermore been found to be advantageous to provide the shutter with a sieve-like bottom unless the oil-fill opening itself is equipped with such a bottom. This bottom serves to protect the valve chamber against the entry of solid objects.

BRIEF DESCRIPTION OF THE DRAWINGS

The invention will be explained in further detail with reference to preferred embodiments illustrated in the accompanying drawings in which corresponding parts are identified by like reference numerals.

FIG. 1 depicts a oil-fill opening with an oil separator according to the invention;

FIG. 1*a* is a cross-sectional view of the oil-fill opening of FIG. 1;

FIGS. 1*b* and 1*c* are views which depict the operation of the shutter.

DETAILED DESCRIPTION OF PREFERRED EMBODIMENTS

Figure 2:
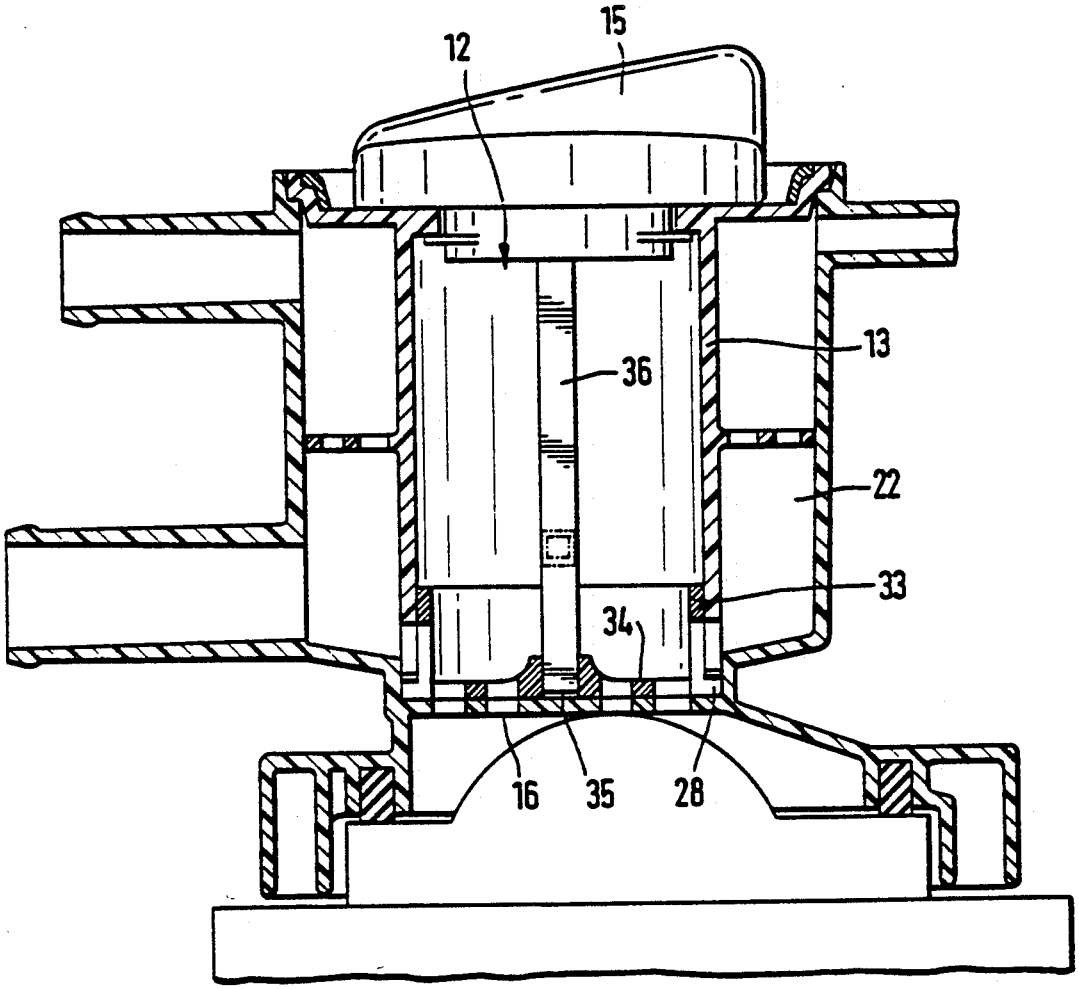
FIG. 2 shows an alternate embodiment of the oil-fill opening of the invention..

FIG. 1 shows the upper part of a valve chamber cover 10. On this valve chamber cover there is fastened a housing 11 which surrounds a oil-fill opening 12. Between the housing 11 and the valve chamber cover 10 there is a sealing ring 37. The oil-fill opening 12 has a tubular configuration and comprises an inner part 13 which is welded to the housing 11 at the weld seam 14. Both parts are molded from plastic.

The oil-fill opening 12 can be closed with a cap 15. This cap has the customary bayonet lock. The housing 11 is provided with a coarse sieve 16. Objects which accidentally get into the oil-fill opening are retained by this coarse sieve 16. Annularly surrounding the oil-fill opening between the housing 11 and the inner part 13 there is a hollow chamber 17 which functions as an oil separator. The oil separator is provided with a first nipple 19. This nipple is connected by a hose to the crankcase. The blow-by gases which form in the crankcase are introduced through this nipple 19 into the oil separator. A baffle grid 18 is provided to improve the separation of oil from the blow-by gases. Baffle grid 18 has an annular configuration and is disposed on the inner part 13. In the upper part of the oil separator are two additional nipples 20 and 21. The blow-by gas exits through these two nipples and is conveyed either to the intake manifold through the nipple 20 or to the clean-air side of the air filter through the nipple 21. When the throttle is closed or slightly open, the blow-by gases are delivered to the motor through the nipple 20 due to the greater vacuum in the intake manifold. When the throttle is open, the blow-by gases pass through nipple 21 into the intake air area due to the greater vacuum on the clean-air side of the filter. The oil collected in the oil separator 22 flows through ports 23 and 24 back into the valve chamber.

When lubricating oil is introduced through the oil-fill opening 12, there is a risk, when very large amounts are poured in rapidly, that the oil will back up in the oil-fill opening 12 and thus also flow through ports 23 and 24 into the oil separator 22. This oil getting into the oil separator can back up in the latter under certain circumstances and pass through the nipples 20 and 21 to the intake manifold and/or to the clean-air side of the air filter. In order to prevent lubricating oil from flowing into the oil separator 22, the ports 23 and 24 are closed when the cap 15 is opened. This is accomplished by means of a shutter 25. The shutter is a hollow cylindrical body which has openings 26 and 27 near its bottom registering with ports 23 and 24 and which is rotatably mounted inside inner part 13.

The shutter is inserted into the housing 11 before the housing 11 is welded to the inner part 13, and is held in place after welding by the flange 28. A flange 28 prevents any axial shifting of the shutter 25.

The shutter 25 is rotated to close the ports 23 and 24. This rotation is positively driven by the cap 15. For this purpose a lug-like projection 29 is situated on the shutter 25 (FIG. 1*a*). This lug-like part is straddled by a driving fork 30 which is provided on the cap 15, so that the rotation of the cap 15 is directly transmitted to the shutter 25. When the cap 15 is closed, the shutter 25 is in the position shown in FIG. 1*b*, i.e., the ports 23 and 24 are open due to the registering position of the openings 26 and 27. The oil collected in the oil separator can flow out unhindered. When the cap 15 is opened, it is opened by a 90-degree rotation of the cap 15. This rotation causes the ports 23 and 24 to be closed, so that no back-up of oil into the oil separator can occur when oil is being added.

To prevent unintentional turning of the shutter 25 while the cap 15 is open, detents 31 and 32 are provided on the shutter 25 in the plane of the ports 23 and 24, as shown in FIG. 1*c*. In the closed position, these detents project into the ports 23 and 24. This assures that, when the cap is placed on the oil-fill opening, the driving fork 30 will straddle the lug-like part 29 and the shutter 25 will be carried along by rotation of the cap.

A variant of the shutter 25 is illustrated in FIG. 2. Here again, the oil separator is arranged immediately adjacent the oil-fill opening 12 as shown in FIG. 1. A shallow shutter 33 having a shorter axial length is inserted in the inner part 13. This shutter is likewise provided with a flange 28 to prevent axial shifting. This shallow shutter rests directly on the coarse sieve 16 and has a bottom 34 which is likewise constructed as a coarse sieve. The bottom 34 is reinforced in the center and provided with a non-circular socket, such as square hole 34, concentric with the cap. A pin with a corresponding configuration, i.e. a square tube 36, is engaged in this square hole. This square tube is disposed on the cap 15 and transmits the turning of the cap 15 to the shallow shutter 33. Of course, the socket and pin could have other configurations such as triangular, rectangular, hexagonal, etc. The operation of the short shutter 33 is analogous to that of the shutter 25 shown in FIG. 1.

It is also possible, of course, to provide other kinds of means for transmitting the movement of the cap to a shutter. For example, it would also be possible to use the axial movement of the cap to open and close the oil separator. All that is needed for this purpose is a suitable means of transmitting the movement of the cap to a shutter.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all variations falling within the ambit of the appended claims and equivalents thereof.

What is claimed is:

1. An oil-fill opening for introducing lubricating oil into a crankcase of an internal combustion engine, comprising a tubular member defining an oil-fill opening (12); a cap (15) with retaining means for opening and closing said oil-fill opening; an oil separator (22) arranged adjacent said oil-fill opening through which blow-by gases from the crankcase of said engine are conducted to an engine intake manifold or to the clean-air side of an engine air filter; at least one return port (23, 24) communicating between said oil separator (22) and said oil-fill opening (12) for returning lubricating oil collected in said oil separator; a shutter (25) comprising a rotary slide valve within said oil-fill opening (12) for opening and closing said return port; and means for connecting said shutter to said cap (15) such that when said oil-fill opening is closed by said cap (15), said shutter is actuated to open said return port (23, 24), and when said oil-fill opening is opened by means of said cap, said shutter is actuated to close said return port (23, 24).

2. An oil-fill opening according to claim 1, wherein said oil separator (22) is arranged annularly surrounding said oil-fill opening (12), and at least two return ports (23, 24) are provided between said oil separator and said oil-fill opening, and wherein said shutter (25) comprises a tube which lies inside said oil-fill opening (12) adjacent a wall thereof and which has at least two openings (26, 27) which uncover said at least two return ports (23, 24) when said oil-fill opening is closed by said cap.

3. An oil-fill opening according to claim 1, wherein said shutter (25) is provided with at least one lug-like projection (29), and said cap (15) is provided with a driving fork (30) which straddles said lug-like projection (29) and transmits rotational movement of said cap (15) to said shutter (25).

4. An oil-fill opening according to claim 1, wherein said shutter (25) has a non-circular socket concentric with said cap in an area facing said cap (15), and said cap (15) comprises a correspondingly configured pin (36) which engages in said socket (35) and transmits rotational movement of said cap (15) to said shutter (33).

5. An oil-fill opening according to claim 1, wherein said shutter (25) comprises at least one detent (31, 32) for preventing unintentional opening of said return ports (23, 24) when said oil-fill opening (12) is open.

6. An oil-fill opening according to claim 1, wherein said shutter (25) has a sieve-like bottom (34).

7. An oil-fill opening according to claim 1, wherein said retaining means comprise a bayonet lock.

8. An oil-fill opening according to claim 1, wherein said oil separator is arranged outside said oil-fill opening on a wall thereof.

* * * * *